US006523266B2

(12) United States Patent
Yang

(10) Patent No.: US 6,523,266 B2
(45) Date of Patent: Feb. 25, 2003

(54) SHEARS

(76) Inventor: Chung-Cheng Yang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/881,188

(22) Filed: Jun. 12, 2001

(65) Prior Publication Data

US 2002/0124414 A1 Sep. 12, 2002

Related U.S. Application Data

(63) Continuation-in-part of application No. 09/483,256, filed on Jan. 12, 2000, now abandoned.

(51) Int. Cl.[7] ..... B26B 13/04; B26B 13/16

(52) U.S. Cl. ..... 30/252; 30/260; 30/261; 30/262; 30/321

(58) Field of Search ..... 30/245, 252, 254, 30/260, 261, 262, 266, 268, 320, 321

(56) References Cited

U.S. PATENT DOCUMENTS 1,299,100 A * 4/1919 Anderson ..... 30/252 X
1,321,745 A * 11/1919 Howard ..... 30/252 X
1,507,529 A * 9/1924 Sundman ..... 30/252 X
2,248,796 A * 7/1941 Vosbikian et al. ..... 30/252
3,187,430 A * 6/1965 Wallace et al. ..... 30/252
3,758,946 A * 9/1973 Peterson ..... 30/260 X
4,439,923 A * 4/1984 Scranton ..... 30/252
5,197,194 A * 3/1993 Sorensen et al. ..... 30/260
5,331,742 A * 7/1994 Schmode et al. ..... 30/245
5,699,617 A * 12/1997 Mock ..... 30/252
5,987,750 A * 11/1999 Tally ..... 30/252 X
6,088,920 A * 7/2000 Schmick ..... 30/252
6,108,845 A * 8/2000 Hung et al. ..... 30/260 X

* cited by examiner

*Primary Examiner*—Charles Goodman

(57) ABSTRACT

A pair of shears has a pair of handles, a pair of front connection portions, and a pair of cutting devices. Each front connection portion is disposed on a front portion of the respective handle. Each front connection portion has a through hole and a through aperture. Each cutting device has a first blade, a second blade, a pivot hole, two positioning grooves, and two round holes. Two extension springs each has two ends inserted in the round holes of the two cutting devices. A bolt passes through two hollow washers, two through holes, two pivot holes, and a nut. A positioning post is inserted in one of the through apertures. A positioning column passes through a hooking plate and is inserted in the other of the through apertures.

1 Claim, 5 Drawing Sheets

SHEARS

The present invention is a continuation-in-part of application Ser. No. 09/483,256, filed on Jan. 12, 2000, now abandoned.

BACKGROUND OF THE INVENTION

The present invention relates to a pair of shears. More particularly, the present invention relates to a pair of gardening shears.

A pair of conventional gardening shears has a pair of blades. It is difficult to replace the pair of blades with the other pair of blades.

SUMMARY OF THE INVENTION

An object of the present invention is to provide a pair of shears which has a pair of cutting devices and each of the cutting devices has two opposite blades to be used for two different purposes.

Another object of the present invention is to provide a pair of shears which has a pair of cutting devices to be replaced easily.

Another object of the present invention is to provide a pair of shears which has a first handle and a second handle to be rotated one hundred and eighty degrees.

Accordingly, a pair of shears comprises a first handle, a second handle, a first front connection frame, a second front connection frame, a first cutting device, and a second cutting device. The first front connection frame is disposed on a front portion of the first handle. The second front connection frame is disposed on a front portion of the second handle. The first front connection frame engages with the second front connection frame. The first front connection frame has a first chamber, a first through hole, and a first through aperture. The second front connection frame has a second chamber, a second through hole, and a second through aperture. The first cutting device is inserted through the first chamber of the first front connection frame. The second cutting device is inserted through the second chamber of the second front connection frame. The first cutting device has a first blade, a second blade, a first pivot hole, two positioning grooves, a first round hole, and a second round hole. The second cutting device has a third blade, a fourth blade, a second pivot hole, two positioning grooves, a third round hole, and a fourth round hole. A first extension spring has a first end inserted in the third round hole of the second cutting device and a second end inserted in the second round hole of the first cutting device. A second extension spring has a third end inserted in the first round hole of the first cutting device and a fourth end inserted in the fourth round hole of the second cutting device. A first hollow washer is disposed on the first front connection frame. A second hollow washer is disposed on the second front connection frame. A bolt passes through the first hollow washer, the first through hole of the first front connection frame, the first pivot hole of the first cutting device, the second through hole of the second front connection frame, the second pivot hole of the second cutting device, the second hollow washer, and a nut to fasten the first front connection frame and the second front connection frame pivotally. A positioning post is inserted in the through aperture of the first front connection frame. A protrusion is disposed on a top portion of the positioning post. A hooking plate has a circular aperture and a T-shaped tail plate. A gasket is disposed on the hooking plate. A positioning column passes through the gasket and the circular aperture of the hooking plate and is inserted in the second through aperture of the second front connection frame.

DETAILED DESCRIPTION OF THE INVENTION

Figure 1:
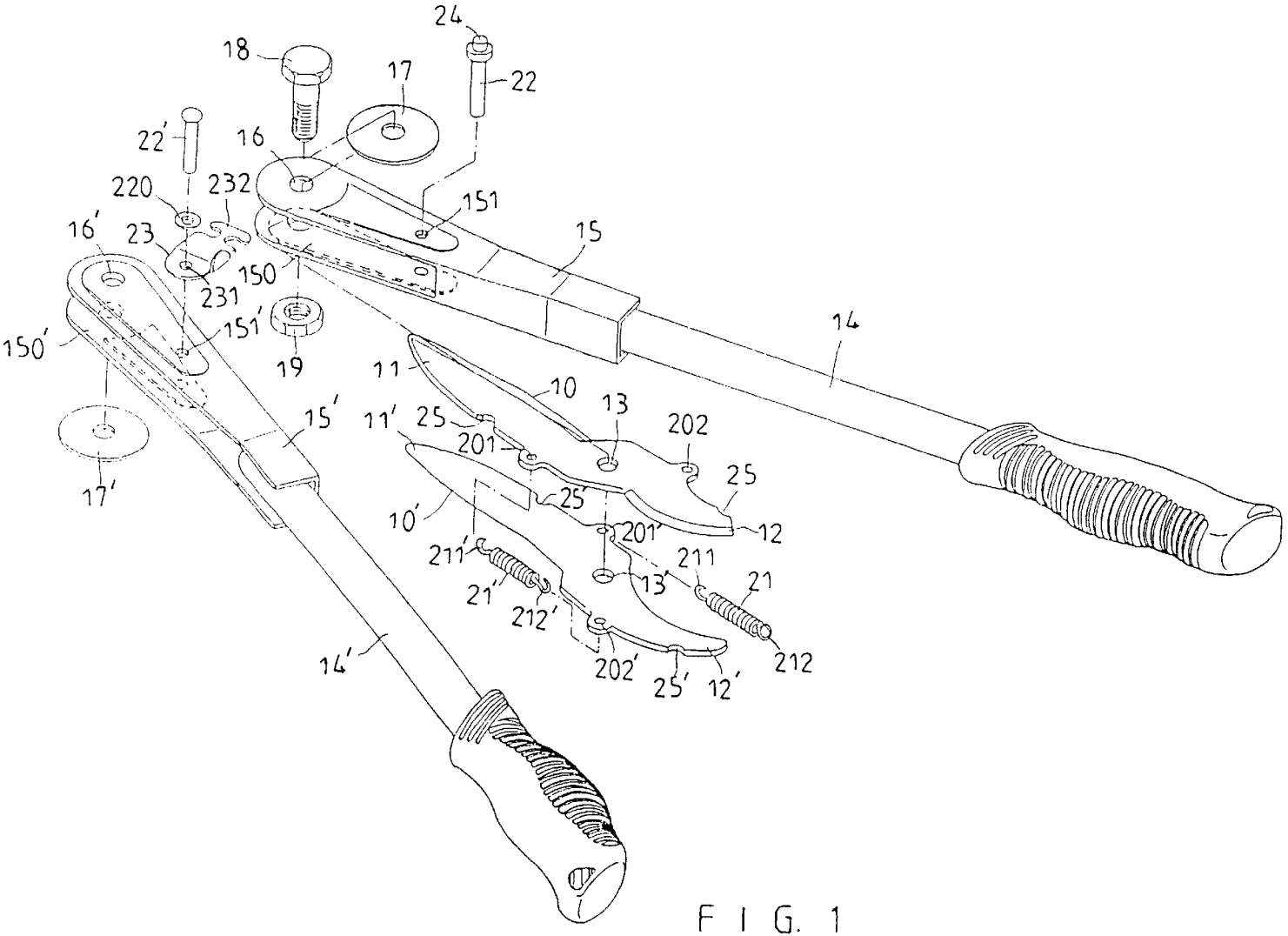
FIG. 1 is a perspective exploded view of a pair of shears of a preferred embodiment in accordance with the present invention.

Referring to FIGS. 1 to 5, a pair of shears comprises a first handle 14, a second handle 14', a first front connection frame 15, a second front connection frame 15', a first cutting device 10, and a second cutting device 10'.

The first front connection frame 15 is disposed on a front portion of the first handle 14.

The second front connection frame 15' is disposed on a front portion of the second handle 14'.

The first front connection frame 15 engages with the second front connection frame 15'.

The first front connection frame 15 has a first chamber 150, a first through hole 16, and a first through aperture 151.

The second front connection frame 15' has a second chamber 150', a second through hole 16', and a second through aperture 151'.

The first cutting device 10 is inserted through the first chamber 150 of the first front connection frame 15.

The second cutting device 10' is inserted through the second chamber 150' of the second front connection frame 15'.

The first cutting device 10 has a first blade 11, a second blade 12, a first pivot hole 13, two positioning grooves 25, a first round hole 201, and a second round hole 202.

The second cutting device 10' has a third blade 11', a fourth blade 12', a second pivot hole 13', two positioning grooves 25', a third round hole 201', and a fourth round hole 202'.

A first extension spring 21 has a first end 211 inserted in the third round hole 201' of the second cutting device 10' and a second end 212 inserted in the second round hole 202 of the first cutting device 10.

A second extension spring 21' has a third end 211' inserted in the first round hole 201 of the first cutting device 10 and a fourth end 212' inserted in the fourth round hole 202' of the second cutting device 10'.

A first hollow washer 17 is disposed on the first front connection frame 15.

A second hollow washer 17' is disposed on the second front connection frame 15'.

A bolt 18 passes through the first hollow washer 17, the first through hole 16 of the first front connection frame 15, the first pivot hole 13 of the first cutting device 10, the second through hole 16' of the second front connection frame 15', the second pivot hole 13' of the second cutting device 10', the second hollow washer 17', and a nut 19 to fasten the first front connection frame 15 and the second front connection frame 15' pivotally.

A positioning post 22 is inserted in the through aperture 151 of the first front connection frame 15.

A protrusion 24 is disposed on a top portion of the positioning post 22.

A hooking plate 23 has a circular aperture 231 and a T-shaped tail plate 232.

A gasket 220 is disposed on the hooking plate 23.

A positioning column 221 passes through the gasket 220 and the circular aperture 231 of the hooking plate 23 and is inserted in the second through aperture 151' of 20 the second front connection frame 15'.

Figure 2:
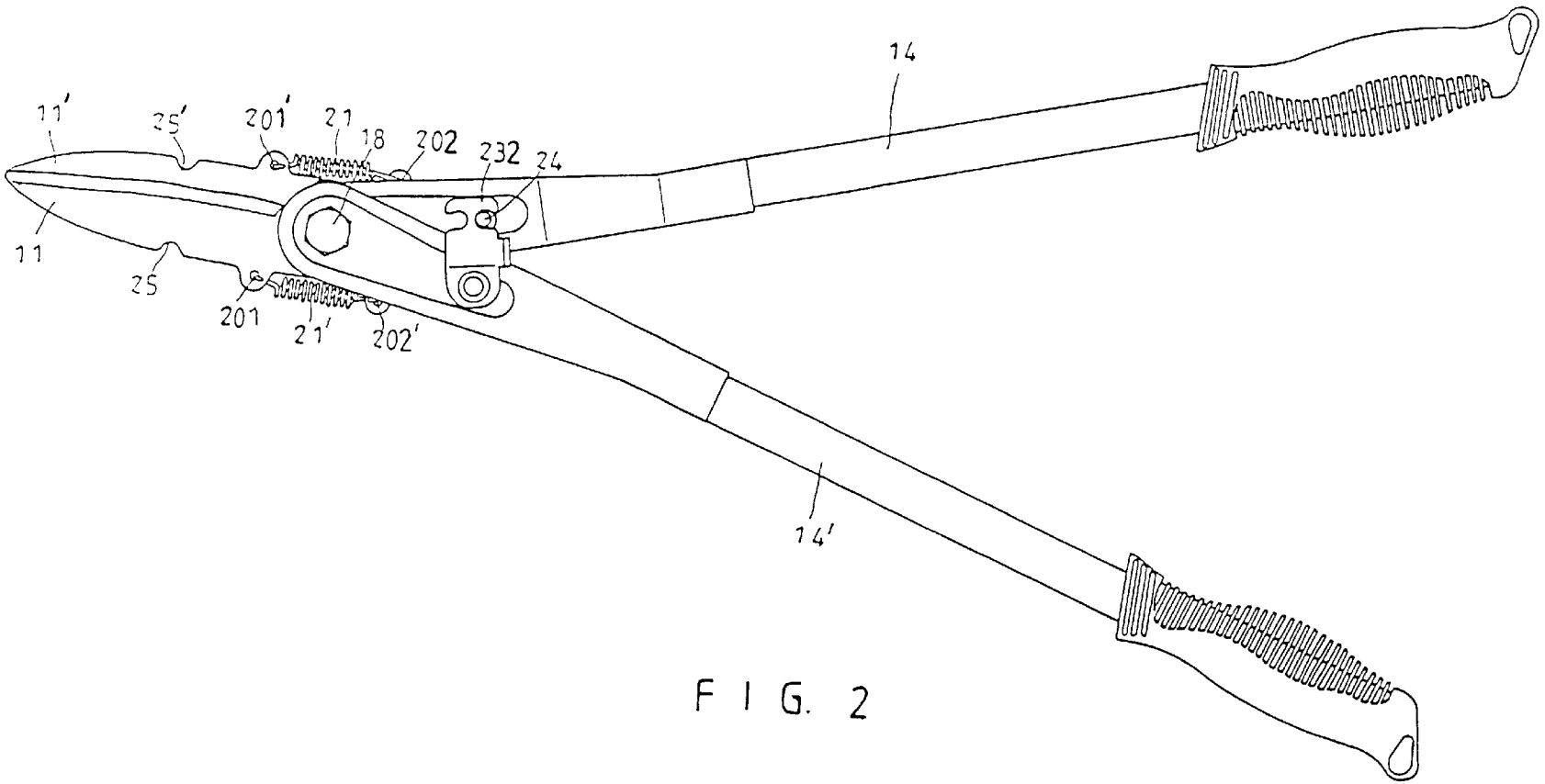
FIG. 2 is a schematic view illustrating a pair of shears of a preferred embodiment is not operated.
Figure 3:
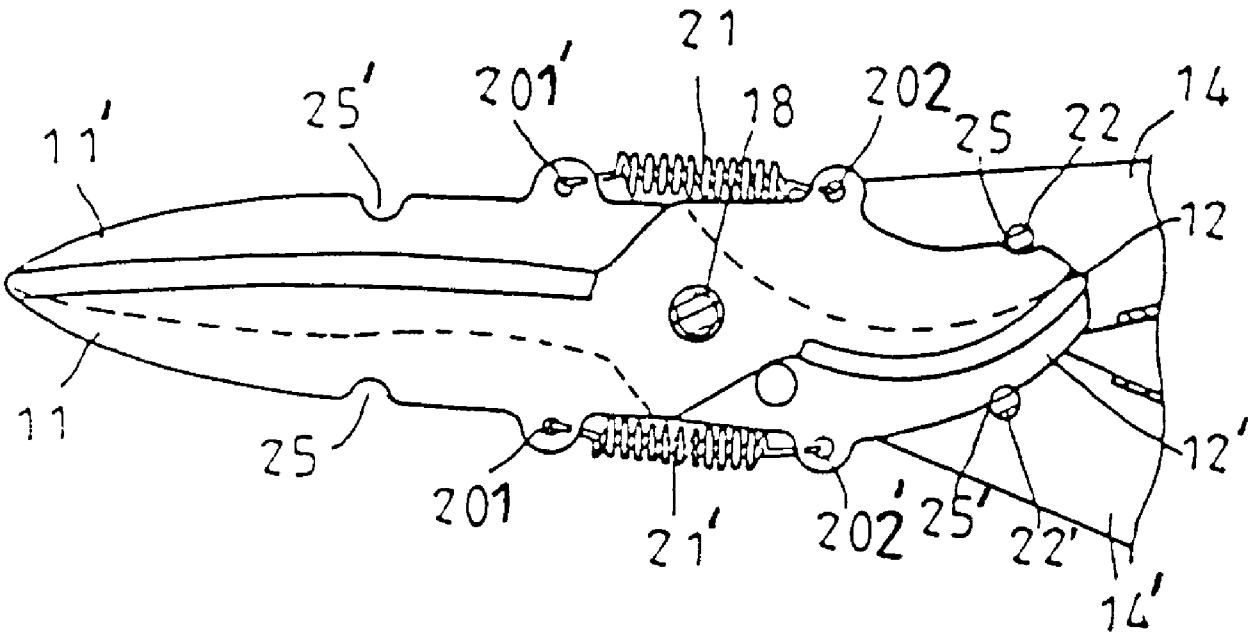
FIG. 3 is a partially enlarged view of FIG. 2.
Figure 4:
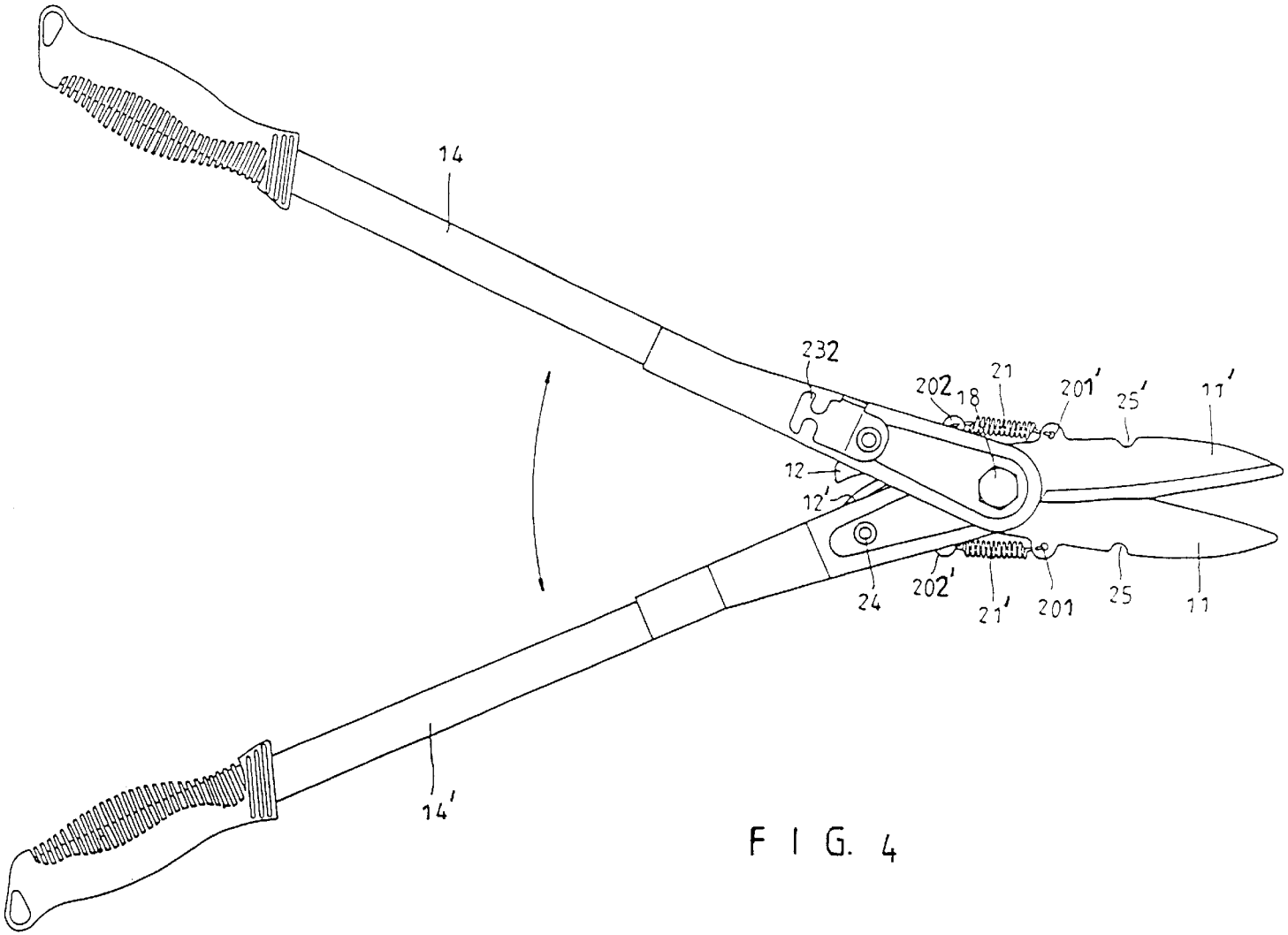
FIG. 4 is a schematic view illustrating a first operation of a pair of shears of a preferred embodiment in accordance with the present invention.
Figure 5:
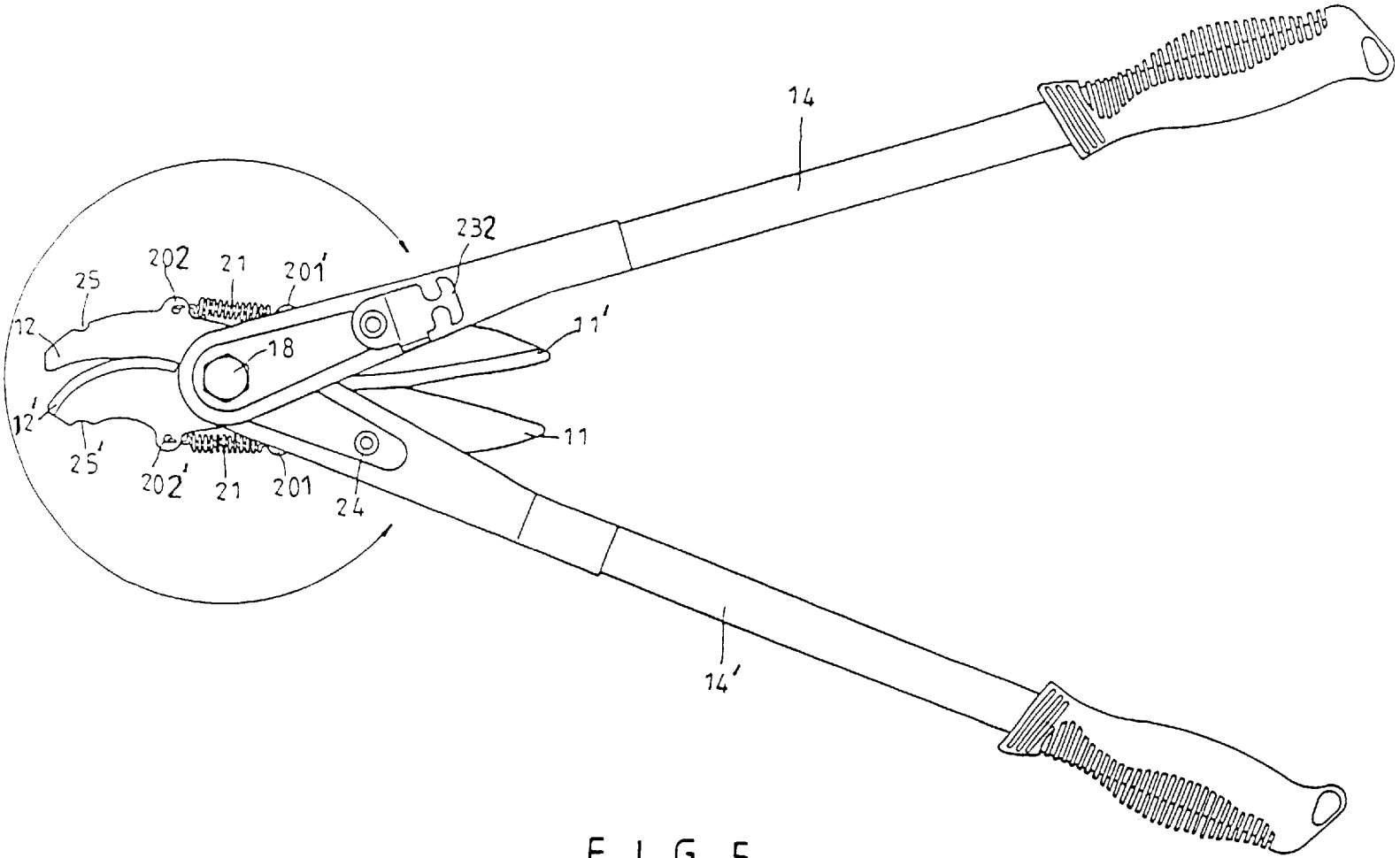
FIG. 5 is a schematic view illustrating a second operation of a pair of shears of a preferred embodiment in accordance with the present invention.

When the hooking plate 23 hooks the protrusion 24, the pair of shears are in an non-operation state (as shown in FIG. 2).

Each of the first cutting device 10 and the second cutting device 10' can be rotated one hundred and eighty degrees until the first blade 11 reaching an original position of the second blade 12.

The present invention has the following advantages. Each of the cutting devices has two opposite blades to be used for two different purposes. A pair of cutting devices can be replaced easily. The first handle and the second handle can be rotated one hundred and eighty degrees.

The present invention is not limited to the above embodiment but various modification thereof may be made. Furthermore, various changes in form and detail may be made without departing from the scope of the present invention.

I claim:

1. A pair of shears comprises:

a first handle, a second handle, a first front connection frame, a second front connection frame, a first cutting device, and a second cutting device, the first front connection frame disposed on a front portion of the first handle, the second front connection frame disposed on a front portion of the second handle, the first front connection frame engaging with the second front connection frame, the first front connection frame having a first chamber, a first through hole, and a first through aperture, the second front connection frame having a second chamber, a second through hole, and a second through aperture, the first cutting device inserted through the first chamber of the first front connection frame, the second cutting device inserted through the second chamber of the second front connection frame, the first cutting device having a first blade, a second blade, a first pivot hole, two positioning grooves, a first round hole, and a second round hole, the second cutting device having a third blade, a fourth blade, a second pivot hole, two positioning grooves, a third round hole, and a fourth round hole, a first extension spring having a first end inserted in the third round hole of the second cutting device and a second end inserted in the second round hole of the first cutting device, a second extension spring having a third end inserted in the first round hole of the first cutting device and a fourth end inserted in the fourth round hole of the second cutting device, a first hollow washer disposed on the first front connection frame, a second hollow washer disposed on the second front connection frame, a bolt passing through the first hollow washer, the first through hole of the first front connection frame, the first pivot hole of the first cutting device, the second through hole of the second front connection frame, the second pivot hole of the second cutting device, the second hollow washer, and a nut to fasten the first front connection frame and the second front connection frame pivotally, a positioning post inserted in the through aperture of the first front connection frame, a protrusion disposed on a top portion of the positioning post, a hooking plate having a circular aperture and a T-shaped tail plate, a gasket disposed on the hooking plate, and a positioning column passing through the gasket and the circular aperture of the hooking plate and being inserted in the second through aperture of the second front connection frame.

* * * * *